United States Patent [19]

Blake et al.

[11] 4,044,718

[45] Aug. 30, 1977

[54] ELECTROSTATIC FOUNTAIN DEVELOPER

[75] Inventors: Stephen D. Blake, North Hollywood; Emil M. Kaegi, La Canada; Eric P. Muntz, Pasadena; Murray S. Welkowsky, Chatsworth, all of Calif.

[73] Assignee: Xonics, Inc., Van Nuys, Calif.

[21] Appl. No.: 722,090

[22] Filed: Sept. 10, 1976

[51] Int. Cl.[2] ..... G03G 15/10

[52] U.S. Cl. ..... 118/647; 118/662; 355/10

[58] Field of Search ..... 118/644, 645, 647, 662, 118/DIG. 23; 355/10; 427/15

[56] References Cited

U.S. PATENT DOCUMENTS

| | | | |
|---|---|---|---|
| 3,667,987 | 6/1972 | Miller | 118/662 |
| 3,782,818 | 1/1974 | Smith | 118/DIG. 23 |
| 3,892,481 | 7/1975 | Schaefer et al. | 118/DIG. 23 |
| 3,964,436 | 6/1976 | Plumadore | 118/622 |

*Primary Examiner*—Henry S. Jaudon

[57] ABSTRACT

A fountain for moving liquid toner into engagement with a receptor for developing an electrostatic image into a visible image. A fountain for providing improved edge enhancement in an image, and incorporating an electrode positioned at the bottom of a liquid toner pool formed by electrical insulating end, side and bottom members.

11 Claims, 6 Drawing Figures

ELECTROSTATIC FOUNTAIN DEVELOPER

BACKGROUND OF THE INVENTION

This invention relates to the developing of electrostatic images such as is performed in xerography and ionography, and in particular, to a new and improved fountain for delivering liquid toner to a receptor for developing an electrostatic image into a visible image.

In a typical system, an electrostatic image of varying charge density is produced on a receptor, such as a selenium plate or a sheet of dielectric plastic. Toner particles are deposited on the receptor, with the toner density being proportional to the electrostatic field density normal to the receptor. The toner is then fixed in place, as by heating, and the image is ready for viewing. In some systems, dry toner is used with the charged receptor being exposed to a cloud of the toner particles. In other systems, liquid toner is used with the charged receptor exposed to a liquid having the toner particles suspended therein.

The present invention provides an improved fountain for delivering the liquid toner to the receptor and is particularly useful with systems wherein the latent electrostatic charge density is small thereby requiring the use of a sensitive toner (low charge per particle) and developing system.

An important difference between electrostatic development and conventional silver halide radiographs resides in the so-called edge enhancement characteristic of the electrostatic image which can be used to emphasize small detail. This feature is related to the fact that the deposition of toner at a given point on the latent image, and hence the final optical density, is determined not only by the charge density at that point, but also by the charge at neighboring points. When a charge gradient is present on the latent image in the form of a step, then fringing electrostatic fields are established, which both prevent toner deposition along one side of the edge of the step, and cause additional development along the other side of the step, This "edge effect" is well known and reference should be made to the literature for more information.

In the development of any electrostatic image, image quality is deteriorated whenever toner is deposited without regard to the charge present on the image receptor. This spurious toner deposit decreases the contrast of the visual image and imparts artifacts to the image. Such degradation is particularly evident in systems where the electrostatic charge on the receptor is small, such as in electronradiograms, a form of x-ray ionography. For further information on the basic image forming system, reference may be made to U.S. Pat. No. 3,774,029.

In order to obtain the charge sensitivity necessary to develop the low charge levels present on an electron radiograph, while concurrently meeting the demands of low toner granularity and fast reliable development, it has been found that electrophoretic (liquid) development is required, as opposed to dry, powder cloud development. Liquid toners have been developed to satisfy these requirements. One known apparatus for delivering the liquid toner to the surface of the receptor carrying the latent image consisted of a metal fountain, wherein the toner formed a shallow pool at the top of the fountain, wetting the receptor as it traversed the fountain. The separation between the top of the fountain and the image plane was in the order of 1 mm. Such a design caused the electrostatic fields to be prependicular between the fountain and the receptor, thus eliminating the fringing fields which yield the desired edge enhancement. Deepening the pool does not alleviate this situation as long as the pool bounderies are close to the image, as the development occurs very rapidly, and is concentrated at those electrically conductive areas of the fountain which are closest to the image. Furthermore, as the pool depth is increased, image artifacts due to non-laminar hydrodynamic flow of the toner become more pronounced, particularly at discontinuities in the pool geometry.

It is an object of the present invention to provide a new and improved apparatus for dispensing liquid toner for developing an electrostatic image which allows edge enhanced development to occur while not creating artifacts due to irregular fluid flow. A further object is to provide such a new and improved fountain which can be directly substituted for the prior art fountain in the developer apparatus.

SUMMARY OF THE INVENTION

A fountain with a body for delivering liquid toner to a pool formed of electrical insulating members with an electrically conductive electrode of finite extent imbedded therein, with the electrode spaced from the image plane of the receptor a sufficient distance to allow for finging electrostatic fields and with all parts of the fountain closer to the electrostatic image than the electrode or located at areas of turbulent toner flow formed of electrical insulating material to impede image development at those sites.

DESCRIPTION OF THE PREFERRED EMBODIMENTS

Figure 1:
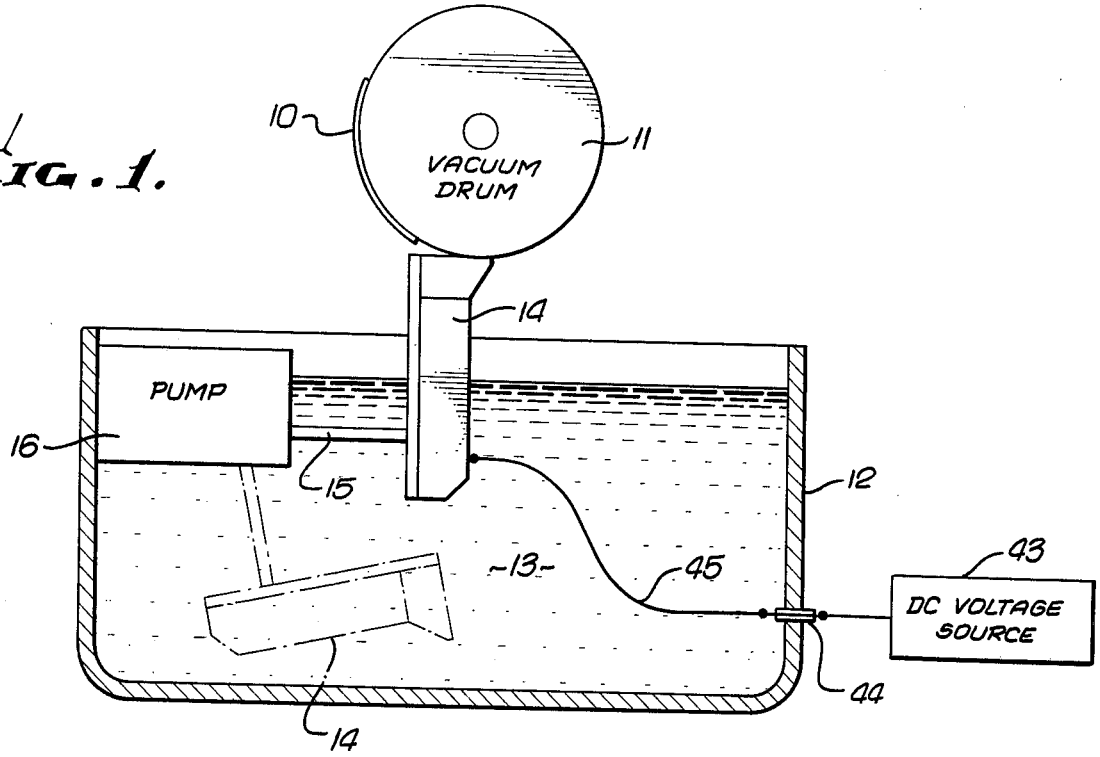
FIG. 1 is a diagramatic illustration of an electrostatic image developer with a fountain incorporating the presently preferred embodiment of the invention.

FIG. 1 illustrates a typical electrostatic image developer with a receptor 10 carried on a drum 11 and held in place by vacuum. The drum is positioned above a tank 12 of liquid toner 13. A fountain 14 is supported on a pipe 15 mounted in a pump housing 16. A pump in the pump housing delivers liquid toner to the fountain through the pipe 15. It is preferred to have the fountain pivotted between a lowered position shown in dashed lines and a raised working position shown in solid lines to prevent toner from drying on the various surfaces of the fountain.

The fountain includes a body 20 with cover plate 21 attached by screws 22'. A liquid toner receptacle is provided in the body and includes a sump 22 and a flow passage 23. Liquid toner is delivered to the pipe 15 into the sump 22 and flows upward through the flow passage 23 into a pool at the upper end of the fountain.

The pool is formed by end members 26, 27, a side member 28, and the upper end of the plate 21 which serves as another side member. The bottom of the pool is formed by a bottom member 31, an electrode 32, and another bottom member 33 which may be formed integrally with the side member 28.

In the embodiment illustrated, the liquid toner flows upward through the passage 23, enters the pool at the upper end of the fountain through an entrance slot 35, flows across the bottom of the pool, and exits over the lip of the side member 28 which is lower than the upper edges of the end members 26, 27 and plate 21. The inner surface of the side member 28 preferably is sloped as shown in FIG. 4 for improved laminar flow from the pool.

Figure 4:
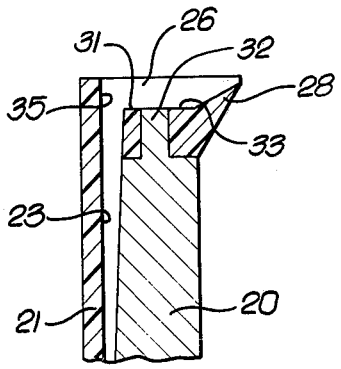
FIG. 4 is a partial sectional view taken along the line 4—4 of FIG. 3.

The electrode 32 is an electrical conducting component and may be a portion of the base 20 as illustrated in FIG. 4, or may be a separate part if desired. The other members 26, 27, 28, 31, 33 and at least the upper end of 21, which form the pool are of electrical insulating material.

Figure 5:
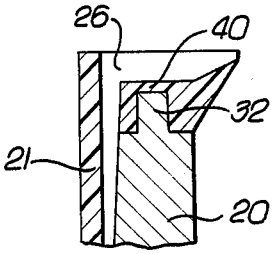
FIG. 5 is a view similar to that of FIG. 4 showing an alternative embodiment of the invention.

The upper surfaces of the electrode 32 and the members 31, 33 are smooth and flush with each other for the purpose of preventing turbulent flow of the liquid toner across the pool bottom. In the alternative embodiment illustrated in FIG. 5, the upper surface of the electrode 32 is below the bottom of the pool, with an insulating member 40 overlying the electrode 32. The member 40 may be separate or may be formed integral with the member 31 or the member 28 or both as desired.

The base 20 may be formed of metal or of an insulator as desired. It is preferred to have at least the surfaces of the base 20 which contact the liquid toner to be electrically conductive for the purpose of preventing toner from caking onto the surface. A carbon impregnated polyethelene can be used for this purpose. The electrical insulating members may be made of various conventional materials which have good electrical resistivity and sufficient physical strength for manufacturing. Typical materials include plexiglass, polycarbonate and teflon.

A dc voltage source 43 may be connected to the electrode 32 by means of a feed through insulator 44 in the side wall of the tank 12 and a flexible conductor 45. The source 43 preferably is variable over the range of 0–500 volts providing for control of bias voltage on the electrode and thereby control of image contrast.

In operation, the fountain is moved from the immersed position to the vertical position of FIG. 1. The upper edges of the end members 26, 27 may serve as position controls by engaging the drum. Alternatively, the position of the fountain can be controlled by the pivoting mechanism. Toner is pumped up into the pool and a receptor is moved through the pool. A meniscus is formed between the liquid and the receptor, allowing toner particles to be attracted to the latent electrostatic image due to the opposite polarity electrostatic charges on the image and the toner.

Typically, the pool is in the order of one to ten millimeters deep. The depth of the pool controls both the edge enhancement and the rate of development. The deeper the pool, the greater the edge enhacement and the lower the development rate. Hence in order to develop an image to a diagnostically acceptable optical density in a reasonable length of time, the pool depth must be limited.

Turbulent flow is very difficult to control at physical discontinuities, such as corners. Turbulent flow in a liquid toner developer produces developed artifacts in the visual image, such as streaks, when the turbulance occurs near an electrode. In the fountain of the present invention, the insulating member 21, 31, 33, 28 prevent such artifacts by significantly decreasing the electrostatic field line intensity at points where turbulence may exist. Development occurs only in the vicinity of the electrode 32 at which there is substantially laminar flow of the liquid across the pool. The development rate is a function of the width of the electrode and typically the width is in the range of 5 to 15 millimeters. The edge enhancement is a function of the gap between the receptor and the electrode and typically is in the range of 1 to 10 millimeters.

Figure 6:
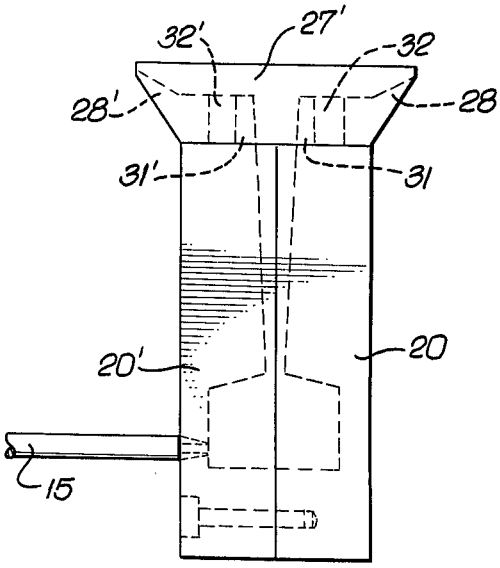
FIG. 6 is a view similar to that of FIG. 2 showing another alternative embodiment of the invention.
Figure 2:
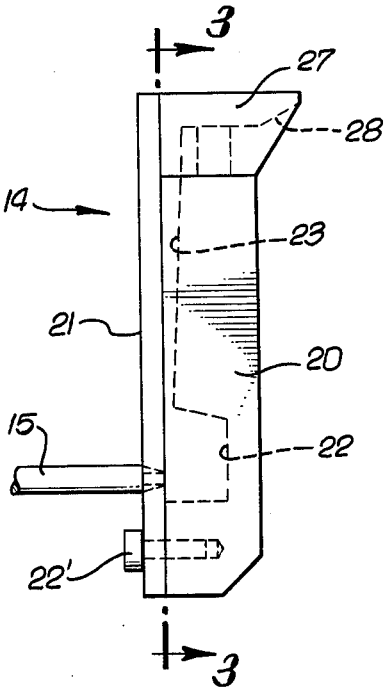
FIG. 2 is an enlarged end view of the fountain of FIG. 1.
Figure 3:
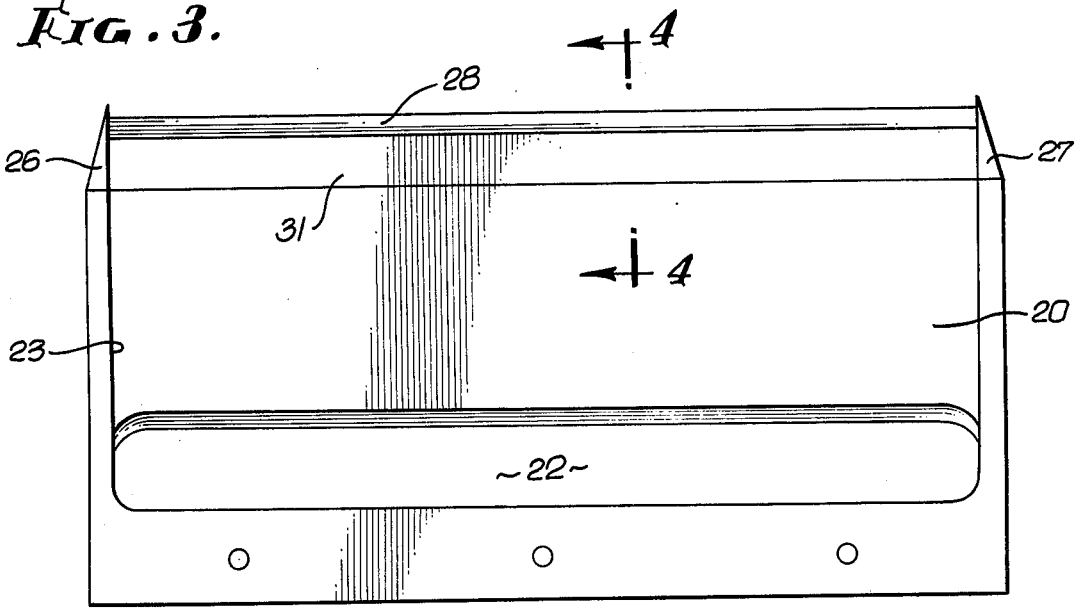
FIG. 3 is a side view of the fountain of FIG. 2 with the cover plate removed.

Another alternative embodiment is illustrated in FIG. 6 wherein a base 20' similar to the base 20 replaces the cover plate 21. The structure forming the pool may be similar to that shown in FIGS. 2–4, with end members 26' (not shown) and 27', side members 28 and 28', electrodes 32 and 32', and bottom members 31 and 31'. The operation is the same as described for the embodiment of FIGS. 2–4, with the liquid toner flowing upward through the flow passage of the base to form the pool at the upper end, and flowing outward over one or both of the side members 28, 28'.

We claim:

1. A toner fountain for an electrostatic image developer having means for moving a receptor past the fountain and a pump for delivering liquid toner to the fountain, the improvement comprising in combination:

a base having a receptacle for liquid toner;

pool means carried at the upper end of said base defining a pool of liquid toner for wetting the receptor, with a flow passage from said receptacle to said pool, said pool means including spaced end members and spaced side members of electrical insulating material, with liquid entering said pool through an entrance slot at the bottom thereof; and an electrode positioned in said pool bottom between said end members, with an electrical insulating bottom member positioned between said entrance slot and said electrode for horizontal fluid flow from said slot across said bottom member so that the liquid toner moving upward from said receptacle through said slot to said pool changes flow direction over said bottom member.

2. A toner fountain as defined in claim 1 wherein the upper surface of said electrode is flush with an exposed at the bottom surface of the pool.

3. A toner fountain as defined in claim 1 wherein the upper surface of said electrode is below the bottom surface of the pool, and including an insulating member over said electrode and flush with the bottom surface of said pool.

4. A toner fountain as definded in claim 1 with said electrode positioned between said insulating bottom member and a second insulating bottom member forming a smooth flat bottom for the pool.

5. A toner fountain as defined in claim 4 wherein said second insulating bottom member is formed integral with one of said side members.

6. A toner fountain as defined in claim 5 wherein said one side member is lower than the other side member defining a fluid flow path upward through said entrance slot, across said pool bottom, and out over said lower side member.

7. A toner fountain as defined in claim 1 wherein one of said side members is lower than the other and has an inner sloping surface defining a fluid flow path upward through said entrance slot, across said pool bottom, up said sloping surface and out over said lower side member.

8. A toner fountain as defined in claim 1 with said end members projecting upward for engagement with said receptor moving means for spacing the pool bottom from the receptor a predetermined distance.

9. A toner fountain as defined in claim 1 wherein at least the surfaces of said base exposed to the liquid toner are electrically conducting.

10. A toner fountain as defined in claim 1 including a second electrode positioned in said pool bottom between said end members and spaced from said one electrode, with a second electrical insulating bottom member positioned between said entrance slot and said second electrode.

11. A toner fountain as defined in claim 1 including means for connecting a dc voltage source to said electrode.

* * * * *

UNITED STATES PATENT AND TRADEMARK OFFICE

CERTIFICATE OF CORRECTION

PATENT NO. : 4,044,718

DATED : August 30, 1977

INVENTOR(S) : Stephen D. Blake, Emil M. Kaegi, Eric P. Muntz, Murray S. Welkowsky It is certified that error appears in the above-identified patent and that said Letters Patent are hereby corrected as shown below:

Column 1, Line 41, delete comma [,] after "step" and substitute period [.]

Column 2, Line 28, correct "finging" to -- fringing --

Column 4, Line 2, correct "turbulance" to -- turbulence --

Line 49, correct "an" to -- and --

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*